US006554632B1

(12) United States Patent
Shao

(10) Patent No.: US 6,554,632 B1
(45) Date of Patent: Apr. 29, 2003

(54) CARD EDGE CONNECTOR WITH CARD RETENTION STRUCTURE

(75) Inventor: Mingbo Shao, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/033,578

(22) Filed: Dec. 27, 2001

(30) Foreign Application Priority Data

Dec. 12, 2001 (TW) ..... 90221691 U

(51) Int. Cl.[7] ..... H01R 13/62

(52) U.S. Cl. ..... 439/327; 439/637; 439/326

(58) Field of Search ..... 439/327, 326, 439/328, 637, 55, 59, 62, 64, 65

(56) References Cited

U.S. PATENT DOCUMENTS 5,192,220 A * 3/1993 Billman et al. ..... 439/327

* cited by examiner

*Primary Examiner*—Renee Luebke
*Assistant Examiner*—Alexander Gilman
(74) *Attorney, Agent, or Firm*—Wei Te Chung

(57) ABSTRACT

An electrical card edge connector (1) includes an insulative housing (2) and a number of electrical contacts (3). The insulative housing has a pair of opposite longitudinal sides (20), a pair of opposite lateral sides (22) connecting with the longitudinal sides and a central slot (24) confined by the longitudinal and the lateral sides. Each lateral side is formed with a pair of arms (220) and a slit (222) between the arms to secure an inserted daughter board to the electrical card edge connector. The electrical contacts are received in the longitudinal sides and are exposed to the central slot to electrically connect with the inserted daughter board.

1 Claim, 6 Drawing Sheets

CARD EDGE CONNECTOR WITH CARD RETENTION STRUCTURE

BACKGROUND OF THE INVENTION

1. Field of the Invention

The present invention relates to an electrical connector, and particularly to an electrical card edge connector for electrically interconnecting a daughter board with a mother board.

2. Description of the Prior Art

U.S. Pat. No. 6,210,195 discloses an electrical card edge connector having an engaging arm outwardly extending from a longitudinal end of an insulative housing thereof and defining a through hole to align with a notch defined in a longitudinal edge of an inserted daughter board. A locking member extends through the notch of the inserted daughter board and the through hole of the engaging arm to prevent the daughter board from escaping from the electrical card edge connector.

Electronic devices are made more and more lighter, shorter, thinner and smaller to comply with the present miniaturization trend in the electronic field while are also required to transmit information more and more faster and in more and more larger quantity. Mother boards of the electronic devices and electrical connectors mounted on the mother boards and communicating the mother boards with other electronic devices or other components of the electronic devices are made smaller than before, and the density of the electrical connectors on each mother board is increased.

Therefore, when the electrical card edge connector of U.S. Pat. No. 6,210,195 is mounted to a mother board having a high density of electrical connectors mounted thereon, it is often difficult to insert the locking member through the through hole and the notch of the inserted daughter board to retain the daughter in position because of closely located neighboring electrical connectors. Furthermore, the card edge connector has to rely on the separate locking member to retain the daughter board thereto, thereby increasing the number of components thereof.

Therefore, an improved electrical card edge connector is desired to overcome the disadvantages of the prior art.

SUMMARY OF THE INVENTION

A major object of the present invention is to provide a structurally simplified electrical card edge connector which easily retains an inserted daughter board.

An electrical card edge connector in accordance with the present invention comprises an insulative housing and a plurality of electrical contacts. The insulative housing comprises a pair of opposite longitudinal sides, a pair of opposite lateral sides connecting with the longitudinal sides and a central slot confined by the longitudinal and the lateral sides. Each lateral side is formed with a pair of arms in an upper portion thereof and extending upwardly beyond a top of the longitudinal side, and a slit between the arms to secure an inserted daughter board to the electrical card edge connector. The electrical contacts are accommodated in the longitudinal sides and are exposed to the central slot to electrically connect with the inserted daughter board.

Other objects, advantages and novel features of the invention will become more apparent from the following detailed description of the present embodiment when taken in conjunction with the accompanying drawings.

DETAILED DESCRIPTION OF THE INVENTION

Figure 1:
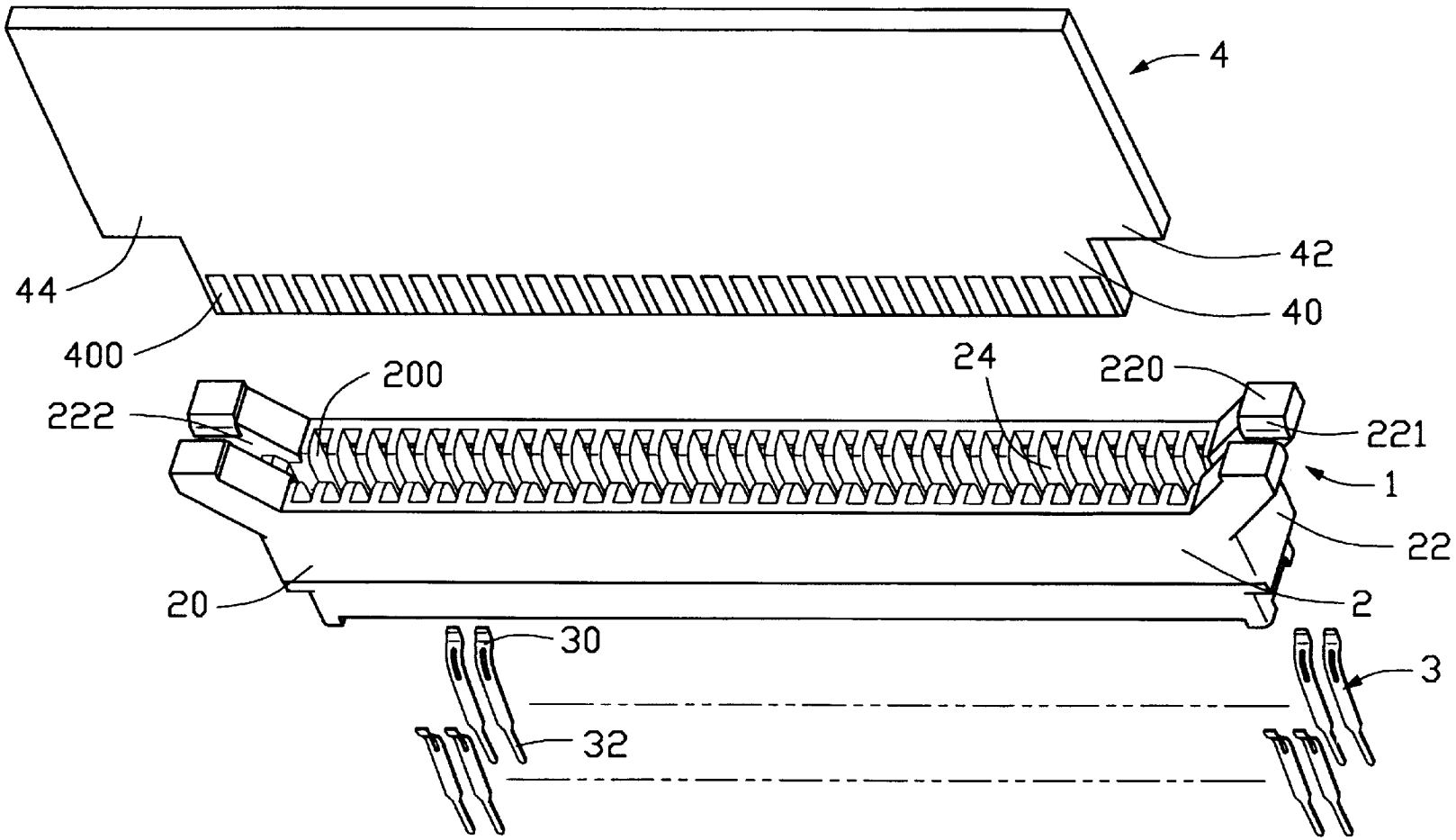
FIG. 1 is an exploded perspective view of an electrical card edge connector in accordance with the present invention and a daughter board.

Referring to FIG. 1, an electrical card edge connector 1 in accordance with the present invention is to electrically interconnect a daughter board 4 with a mother board (not shown) to which the electrical card edge connector 1 is mounted. The daughter board 4 has an engaging portion 40 having a plurality of contacting pads 400 on opposite side surfaces thereof (only one side shown) and a retention portion 42 extending from the engaging portion 40 and having a pair of opposite side edges 44 extending outwardly beyond two opposite sides of the engaging portion 40.

Referring also to FIGS. 3–6, the electrical card edge connector 1 comprises an insulative housing 2 and a plurality of electrical contacts 3. The insulative housing 2 comprises a pair of opposite longitudinal sides 20, a pair of opposite lateral sides 22 connecting with the longitudinal sides 20, and a longitudinal central slot 24 confined by the longitudinal and the lateral sides 20, 22. Each longitudinal side 20 defines a plurality of passageways 200 extending therethrough and communicating with the central slot 24. Each lateral side 22 is formed with a pair of opposite arms 220 in an upper portion thereof and extending upwardly and outward beyond a top of each longitudinal side 20, and a slit 222 between the arms 220 and in line with the central slot 24. The opposite arms 220 of each lateral side 22 comprise a pair of protrusions 221 extending from inner surfaces of upper portions thereof and facing toward each other, thereby defining a gap therebetween which is smaller than other portions of the arms 220.

Each electrical contact 30 comprises a contacting portion 30 received in the passageways 200 of the longitudinal sides 20 and exposed into the central slot 24 and a mounting portion 32 extending beyond a bottom of the insulative housing 2 to electrically connect with and mechanically mount to the mother board.

Figure 2:
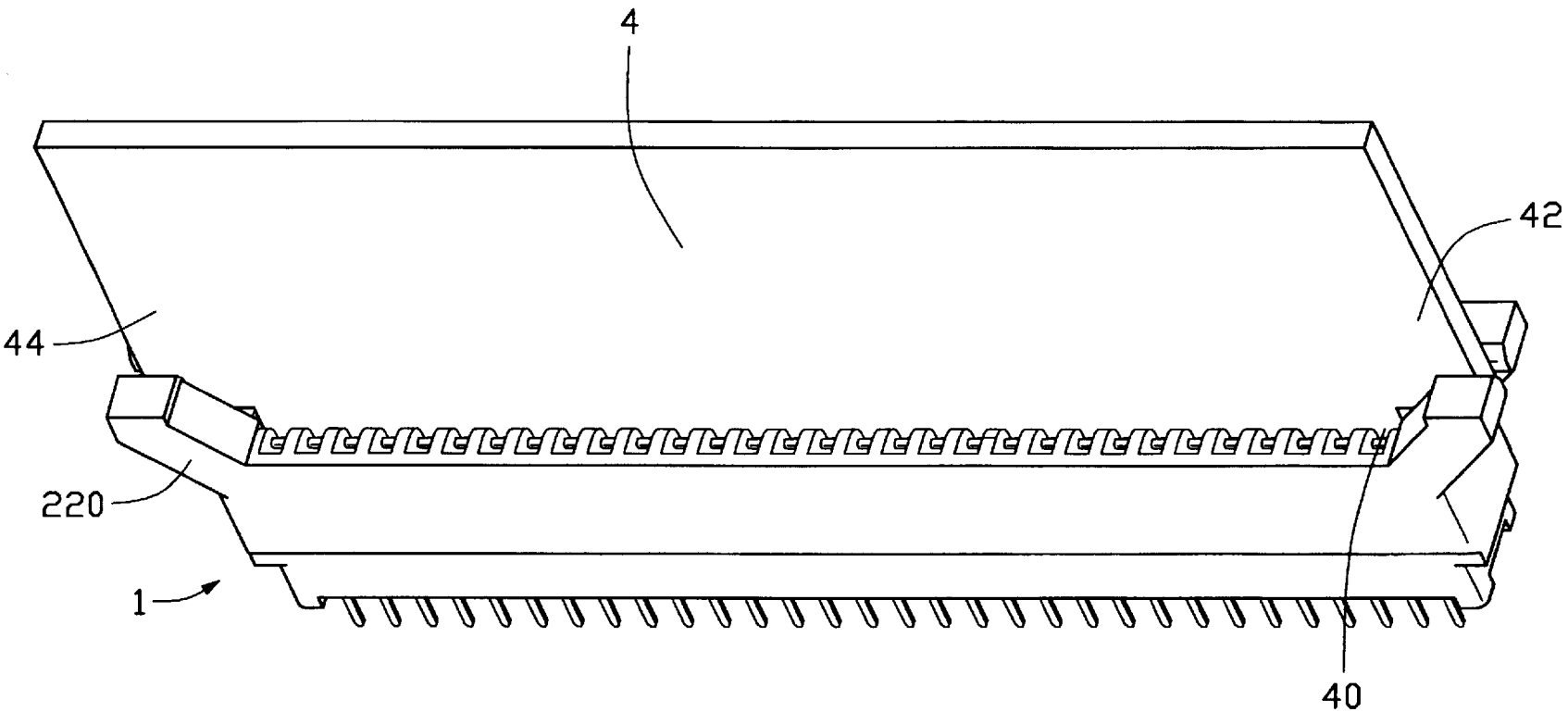
FIG. 2 is an assembled perspective view of the electrical card edge connector of FIG. 1 with the daughter board being inserted thereinto.
Figure 3:
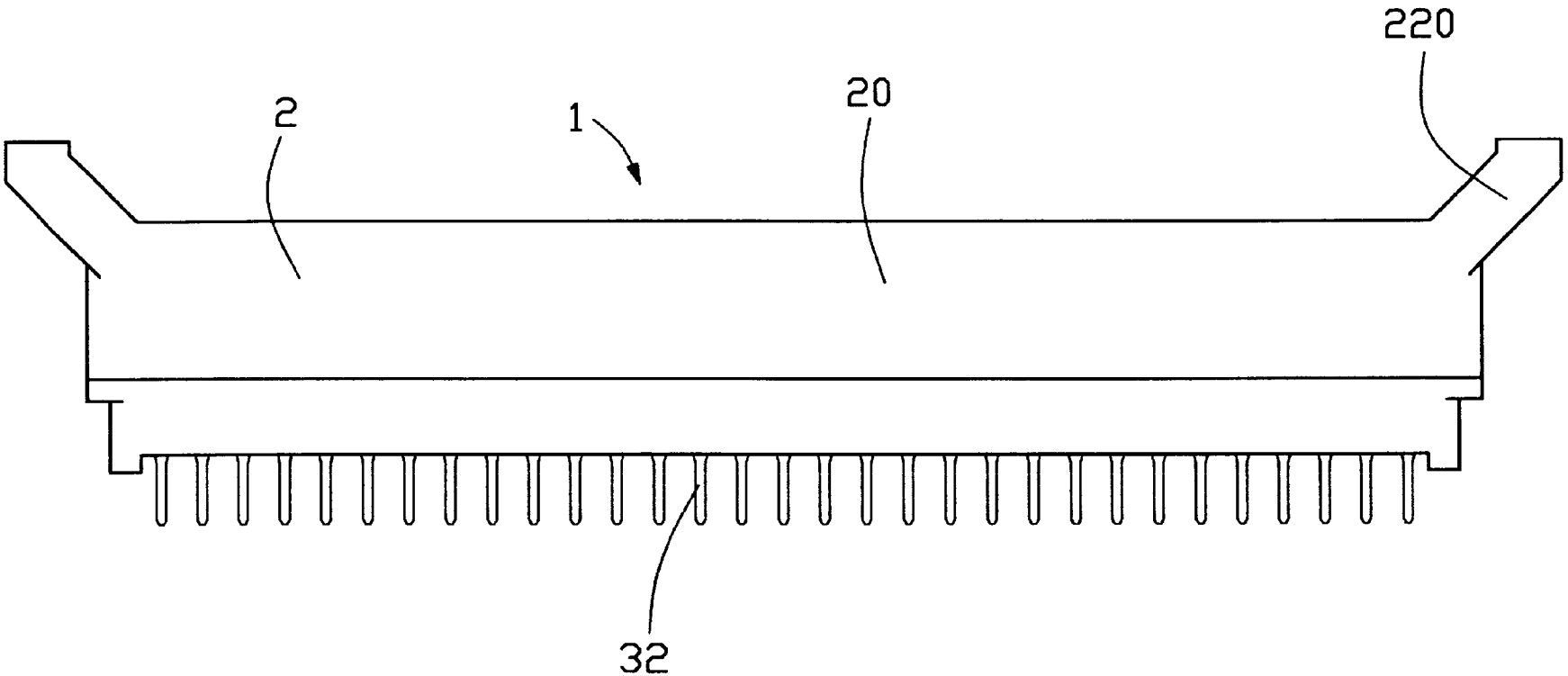
FIG. 3 is a front planar view of the electrical card edge connector of FIG. 1.
Figure 4:
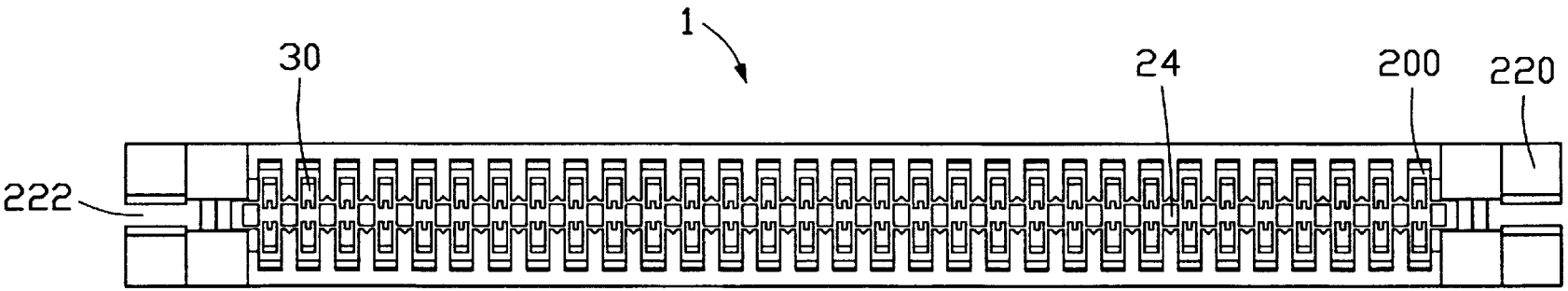
FIG. 4 is a top planar view of the electrical card edge connector of FIG. 1.
Figure 5:
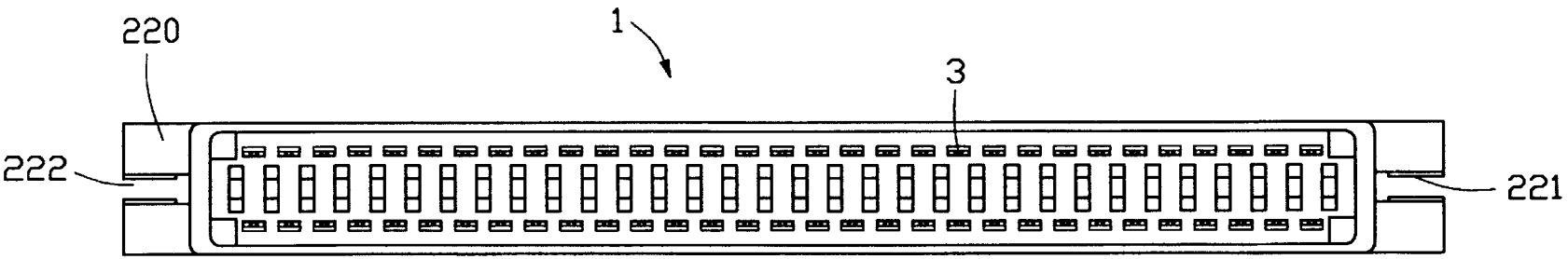
FIG. 5 is a bottom planar view of the electrical card edge connector of FIG. 1.
Figure 6:
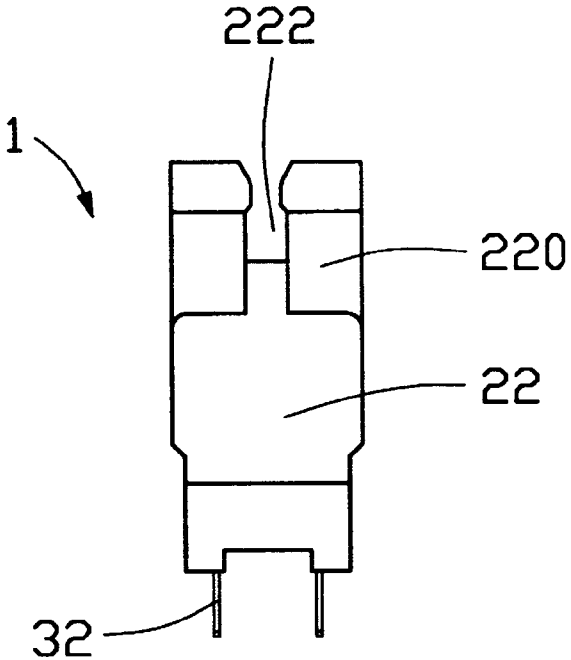
FIG. 6 is a side-elevational view of the electrical card edge connector of FIG. 1.

Referring to FIG. 2, when the daughter board 4 is to be engaged with the electrical card edge connector 1, the engaging portion 40 of the daughter board 4 is inserted into the central slot 24 to engage the contacting pads 400 with the contacting portions 30 of the electrical contacts 3 in ways known to persons skilled in the pertinent art and the retention portion 42 is situated beyond the top of longitudinal sides 20. Lower portions of the side edges 44 of the retention portion 42 are pressed in the slits 221 between the protrusions 221 of the arms 220 to prevent the daughter board 4 from escaping from the electrical card edge connector 1.

As is clearly seen herein, the daughter board 4 is simply retained to the electrical card edge connector 1 by the arms

220 of the insulative housing 2 thereof, thereby needing no separate elements and facilitating manipulation by users.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulative housing defining a central slot with a plurality of contacts by two sides thereof;

two pairs of arms upwardly, obliquely and outwardly extending from two opposite lateral sides of the housing, at angle about 45 degrees regarding a mating direction respectively, each pair of arms defining a pair of protrusions located outside of the corresponding lateral side with a gap therebetween; said protrusions extending inwardly in a direction perpendicular to said mating direction and a printed circuit board including a bottom portion received within the central slot, and a pair of lateral sections respectively seated upon the corresponding lateral sides of the housing and retainably received in the corresponding gap so as to form retention between the connector and the printed circuit board in two categories in which one is lower retention within the housing and the other is upper retention outside of the housing.

* * * * *